US007771192B2

(12) United States Patent
Kondo et al.

(10) Patent No.: US 7,771,192 B2
(45) Date of Patent: Aug. 10, 2010

(54) COMBUSTION APPARATUS

(75) Inventors: Kanta Kondo, Matsuyama (JP); Koichi Masuda, Matsuyama (JP); Tatsuya Fujiwara, Brantford (CA)

(73) Assignee: Miura Co., Ltd., Ehime-ken (JP)

( * ) Notice: Subject to any disclaimer, the term of this patent is extended or adjusted under 35 U.S.C. 154(b) by 237 days.

(21) Appl. No.: 11/368,462

(22) Filed: Mar. 7, 2006

(65) Prior Publication Data

US 2006/0204912 A1 Sep. 14, 2006

(30) Foreign Application Priority Data

Mar. 8, 2005 (JP) ..... 2005-064036

(51) Int. Cl.
*F23Q 9/00* (2006.01)
*F23Q 9/08* (2006.01)

(52) U.S. Cl. ..... 431/278; 431/280; 431/160; 137/599.01

(58) Field of Classification Search ..... 431/278, 431/280, 160, 6, 12, 18, 42, 49, 60, 72; 137/599.01; 60/748

See application file for complete search history.

(56) References Cited

U.S. PATENT DOCUMENTS

| | | | | | |
|---|---|---|---|---|---|
| 1,874,969 | A | * | 8/1932 | Hall | 431/51 |
| 1,955,797 | A | * | 4/1934 | Engstrom | 431/281 |
| 3,730,668 | A | * | 5/1973 | Iida et al. | 431/10 |
| 3,800,530 | A | * | 4/1974 | Nash | 60/761 |
| 5,353,748 | A | | 10/1994 | Kayahara et al. | |
| 5,372,497 | A | * | 12/1994 | Coolidge et al. | 431/6 |
| 5,453,002 | A | * | 9/1995 | Scott | 431/6 |
| 6,792,895 | B2 | | 9/2004 | Kayahara et al. | |
| 6,793,485 | B2 | | 9/2004 | Kayahara et al. | |
| 6,823,821 | B2 | | 11/2004 | Kayahara et al. | |
| 6,875,009 | B2 | | 4/2005 | Kayahara et al. | |

FOREIGN PATENT DOCUMENTS

| | | | |
|---|---|---|---|
| JP | 1-212820 | A | 8/1989 |
| JP | 1212820 | A * | 8/1989 |
| JP | 10-196942 | A | 7/1998 |
| JP | 3221582 | B2 | 8/2001 |
| JP | 2002-106833 | A | 4/2002 |

OTHER PUBLICATIONS

The Notification of Reasons of Refusal for Japanese Patent Appl. No. 2005-064036, drafted Sep. 19, 2008.

* cited by examiner

*Primary Examiner*—Kenneth B Rinehart
*Assistant Examiner*—Chuka C Ndubizu
(74) *Attorney, Agent, or Firm*—Birch, Stewart, Kolasch & Birch, LLP

(57) ABSTRACT

An object of the present invention is to provide a combustion apparatus equipped with a pilot burner and a main burner capable of establishing a stable combustion state without involving generation of CO and unburned substances at the main burner even when the supply of a gas fuel to the pilot burner is stopped. A combustion apparatus equipped with a pilot burner and a main burner according to the present invention is characterized in that, when the main burner is in a combustion state, the amount of air supplied to the pilot burner can be adjusted. Here, the amount of air supplied to the pilot burner is an amount allowing the pilot burner to be cooled.

5 Claims, 4 Drawing Sheets

COMBUSTION APPARATUS

BACKGROUND OF THE INVENTION

1. Field of the Invention

The present invention relates to a combustion apparatus for use in a boiler or the like and, more particularly, to a combustion apparatus equipped with a pilot burner and a main burner.

2. Description of the Related Art

As a known example of the combustion apparatus of a boiler formed so as to burn a gas fuel to obtain steam and hot water, there exists one equipped with a pilot burner and a main burner (see, for example, JP 10-196942 A).

Here, the "pilot burner" is a burner provided to function as an ignition means for igniting the main burner, and is provided adjacent to the main burner. The "main burner" is a burner formed so as to be capable of supplying a gas fuel required in the boiler, and can be switched between low combustion and high combustion as needed. Pilot burners of different combustion types are known, for example, one that is extinguished after the ignition of the main burner or one that continues to burn together with the main burner.

The combustion apparatus as disclosed in JP 10-196942 A has a main burner and a pilot burner positioned beside the main burner, and a gas fuel is supplied to the main burner and the pilot burner through piping branched off from a gas supply pipe. After the ignition of the pilot burner has been confirmed, the gas fuel is supplied to the main burner, and the ignition of the main burner is effected by using the flame of the pilot burner. In this prior-art technique, to reduce the possibility of defective ignition, a plurality of pilot burners are provided for one main burner.

The combustion apparatus according to the above-described prior-art technique has a blower for supplying combustion air, and combustion air is supplied to the pilot burner and the main burner from a single blower. In the combustion apparatus, constructed as described above, the pilot burners are extinguished after the ignition of the main burner. That is, after the ignition of the main burner has been confirmed, no gas fuel is supplied to the pilot burner.

However, in the prior-art technique, even after the supply of gas fuel to the pilot burner has been stopped, the combustion air from the blower continues to be supplied thereto. Thus, air that has passed by way of the pilot burner is also supplied to the portion in the vicinity of the main burner, which makes the combustion state of the main burner rather unstable and adversely affects the combustion.

To be more specific, the air from the pilot burner is blown against the flame formed by the main burner, so the flame temperature is locally reduced, resulting in generation of CO and unburned substances.

SUMMARY OF THE INVENTION

The present invention has been made with a view toward solving the above problem in the prior art. It is an object of the present invention to make it possible to establish a stable combustion state without involving generation of CO and unburned substances at the main burner even when the supply of a gas fuel to the pilot burner is stopped.

To achieve the above object, the present invention provides a combustion apparatus includes: a pilot burner; and a main burner, characterized in that, when the main burner is a combustion state, an amount of air supplied to the pilot burner can be adjusted. To be more specific, the present invention provides a combustion apparatus equipped with a pilot burner and a main burner, characterized in that, when the main burner is in the combustion state, the supply of fuel to the pilot burner is stopped, the amount of air supplied to the pilot burner can be adjusted.

Further, in a combustion apparatus according to the present invention, it is preferable that the amount of air supplied to the pilot burner be an amount allowing the pilot burner to be cooled.

Still further, in a combustion apparatus according to the present invention, it is preferable that the amount of air supplied to the pilot burner be zero, and air for cooling the pilot burner be supplied to an outer side of the pilot burner.

Yet further, it is preferable that the combustion apparatus according to the present invention further include a supply amount adjusting means capable of adjusting an air supply amount provided in an air supply route connected to the pilot burner.

Furthermore, in a combustion apparatus according to the present invention, it is preferable that the supply amount adjusting means be formed by an electromagnetic valve provided in the air supply route.

Further, the present invention has been made with a view toward solving the above problem in the prior art, and provides a combustion apparatus including: a pilot burner; a main burner; and an air supply route for supplying air to the pilot burner provided therein so that the air supply route is branched off from the upstream side of a damper for adjusting an amount of air supplied to the main burner, characterized in that the air supply route includes a supply amount adjusting means capable of adjusting an amount of air supplied to the pilot burner provided therein.

According to the present invention, it is possible to obtain a combustion apparatus including: a pilot burner; and a main burner, in which, even when the supply of a gas fuel to the pilot burner is stopped, it is possible to establish a stable combustion state without involving generation of CO and unburned substances at the main burner.

Prior to the description of embodiments of the present invention, some of the terms used in this specification will be defined.

In this specification, unless otherwise specified, the term "gas" represents a concept covering at least one of the following: a gas undergoing combustion reaction and a gas that has completed combustion reaction; it may also be referred to as combustion gas. That is, the term "gas" represents a concept covering all of the following cases: a case in which there exist both a gas undergoing combustion reaction and a gas that has completed combustion reaction, a case in which there exists only a gas undergoing combustion reaction, and a case in which there exits only a gas that has completed combustion reaction. This applies to the following description unless otherwise specified.

Further, unless otherwise specified, the term "gas temperature" means the temperature of a gas undergoing combustion reaction, and is synonymous with combustion temperature or combustion flame temperature. Further, the expression: "suppression of gas temperature" means keeping a maximum value of gas (combustion flame) temperature at low level. Usually, combustion reaction continues, if in a minute amount, even in a "gas that has completed combustion reaction", so the expression: "completion of combustion reaction" does not mean completion by 100% of combustion reaction.

In the following, embodiment modes of the present invention will be described.

According to a first aspect of this embodiment mode, there is provided a combustion apparatus equipped with a pilot burner and a main burner, characterized in that, when the main burner is in the combustion state, the amount of air supplied to the pilot burner can be adjusted. That is, in the combustion apparatus of the first aspect, the amount of air supplied to the pilot burner can be adjusted prior to the ignition of the main burner (at the time of ignition of the pilot burner) and after the ignition of the main burner (at the time of extinction of the pilot burner).

Here, the "pilot burner" is a burner provided to function as an ignition means for igniting the main burner, and is provided beside the main burner. The "main burner" is a burner formed so as to be capable of supplying the requisite gas fuel to the boiler, and can be switched in combustion amount between a number of stages (low combustion, high combustion, etc.) as needed.

As the main burner forming the combustion apparatus of the first aspect, there is used, for example, a premixed burner which is in the form of a flat plate and in which premixed gas ejection holes are formed substantially in the same plane. Example of the premixed burner includes a premixed gas burner in which corrugated plates and flat plates are alternately stacked together to provide a large number of premixed gas ejection holes. However, the main burner of this embodiment mode is not restricted to this construction. While a burner in which premixed gas ejection holes are formed substantially in the same plane is preferable, it is possible to adopt any other construction. Thus, for example, it is also possible to form the main burner of this embodiment mode by using a ceramic plate having a large number of ejection holes for ejecting premixed gas.

Further, there are no particular limitations regarding the construction of the pilot burner forming the combustion apparatus of the first aspect as long as it is provided adjacent to the main burner. For example, there may be used a pilot burner in which a cylindrical premixed gas ejection portion is provided in the vicinity of the main burner. Alternatively, there may be used a pilot burner in the form of a flat plate which is provided adjacent to the main burner and in which premixed gas ejection holes are formed substantially in the same plane.

In the combustion apparatus of the first aspect, when the main burner is in the combustion state, the amount of air supplied to the pilot burner can be adjusted, so it is possible to obtain a combustion apparatus in which the amount of air supplied to the pilot burner is adjusted as needed so as not to interfere with the combustion at the main burner. That is, the air from the pilot burner is not blown in an excessive amount against the flame formed by the main burner, so it is possible to prevent a local reduction in flame temperature and to suppress generation of CO and unburned substances.

According to a second aspect of this embodiment mode, the combustion apparatus of the first aspect is modified such that the amount of air supplied to the pilot burner is an amount allowing cooling of the pilot burner. That is, in the combustion apparatus of the second aspect, the amount of air supplied to the pilot burner can be adjusted prior to the ignition of the main burner (at the time of ignition of the pilot burner) and after the ignition of the main burner (at the time of extinction of the pilot burner), and the amount of air supplied to the pilot burner is one allowing cooling of the pilot burner.

With this construction, the amount of air from the pilot burner is not "zero" but an amount allowing cooling of the pilot burner, so the air from the pilot burner is not blown in an excessive amount against the flame formed by the main burner, and it is possible to achieve an improvement in the durability of the pilot burner itself.

According to a third aspect of this embodiment mode, the combustion apparatus of the first aspect is modified such that the amount of air supplied to the pilot burner is zero and that air for cooling the pilot burner is supplied to the outer side of the pilot burner. That is, in the combustion apparatus of the third aspect, after the ignition of the main burner (at the time of extinction of the pilot burner), the amount of air supplied to the pilot burner is "zero", and a slight amount of air is supplied to the outer side of the pilot burner.

With this construction, the amount of air from the pilot burner is "zero", so after the ignition of the main burner, no air from the pilot burner is blown against the flame formed by the main burner. That is, the combustion state of the main burner is not adversely affected by the air from the pilot burner, so it is possible to eliminate a local reduction in flame temperature and to suppress generation of CO and unburned substances. Further, with this construction, a slight amount of air is supplied to the outer side of the pilot burner, so it is also possible to achieve an improvement in the durability of the pilot burner itself.

According to a fourth aspect of this embodiment mode, the combustion apparatuses of the first through third aspects are modified such that an air supply route connected to the pilot burner is provided with a supply amount adjusting means capable of adjusting air supply amount.

According to a fifth aspect of this embodiment mode, the combustion apparatus of the fourth aspect is modified such that the supply amount adjusting means is formed by using an electromagnetic valve provided in the air supply route.

The combustion apparatus of this embodiment mode is not restricted to the fifth aspect described above, and the component constituting the supply amount adjusting means is not restricted to the electromagnetic valve. Thus, it is possible to adopt any other component, such as a damper or an orifice, as long as it can adjust air amount.

According to a sixth aspect of this embodiment mode, there is provided a combustion apparatus equipped with a pilot burner and a main burner, characterized in that an air supply route for supplying air to the pilot burner is provided so as to be branched off from the upstream side of a damper for adjusting the amount of air supplied to the main burner, and there is provided a supply amount adjusting means capable of adjusting the amount of air supplied to the pilot burner.

With this construction, even in the case in which the amount of air supplied to the main burner is adjusted by the damper, the amount of air supplied to the pilot burner is appropriately adjusted by the supply amount adjusting means. To be more specific, when the amount of air supplied to the main burner is reduced by the damper, the air pressure in the air supply route provided so as to be branched off from the upstream side of the damper is enhanced, so, in a construction in which no supply amount adjusting means is provided, the amount of air supplied to the pilot burner increases. However, in this embodiment mode, the supply amount adjusting means is provided, so even when the amount of air supplied to the main burner is reduced by the damper as stated above, it is possible to properly adjust the amount of air supplied to the pilot burner. Thus, with this construction, the combustion state of the main burner is not adversely affected by the air from the pilot burner, and it is possible to eliminate a local reduction in the flame temperature at the main burner and to suppress generation of CO and unburned substances.

While in the above description of the embodiment modes no particular mention has been made of the configuration of a boiler or the like allowing the installation of the combustion apparatus, there are no limitations in this regard in the present invention. That is, the combustion apparatuses of the above embodiment modes can be mounted in boilers or the like of various configurations.

For example, the combustion apparatuses of the above embodiment modes can be mounted in a boiler equipped with a boiler body formed by using a large number of heat absorbing water tubes (heat transfer tubes). A boiler body constituting a boiler is equipped with an upper header and a lower header, and a plurality of water tubes are arranged upright between the upper and lower headers. As an example, a so-called "square type boiler body" may be mentioned, in which a large number of water tubes provided between the upper and lower headers are arranged at predetermined intervals within a substantially rectangular gas flowing space. When mounting a combustion apparatus according to any one of the above embodiment modes in such a boiler, the combustion apparatus is provided in close proximity to one side surface of this square type boiler body.

A combustion apparatus according to any one of the above embodiment modes may be mounted not only in a square type boiler body as mentioned above, but also in a "round type boiler body" in which water tubes are arranged circumferentially (or in which a plurality of water tube groups are arranged concentrically).

Further, a combustion apparatus according to any one of the above embodiment modes can be mounted not only in a boiler, but also in some other apparatus, for example, a water heater, or a thermal component, such as a reheater of an absorption refrigerating machine.

Next, embodiments of the present invention will be described. It should be noted, however, that the present invention is not restricted to the embodiment modes described above or the embodiments described below and naturally allows appropriate variations without departing from the gist of the present invention as described above and below, all of such variations being covered by the technical scope of the present invention.

DETAILED DESCRIPTION OF THE PREFERRED EMBODIMENTS

In the following, embodiments to which the combustion apparatus of the present invention is applied will be described with reference to the drawings.

Figure 1:
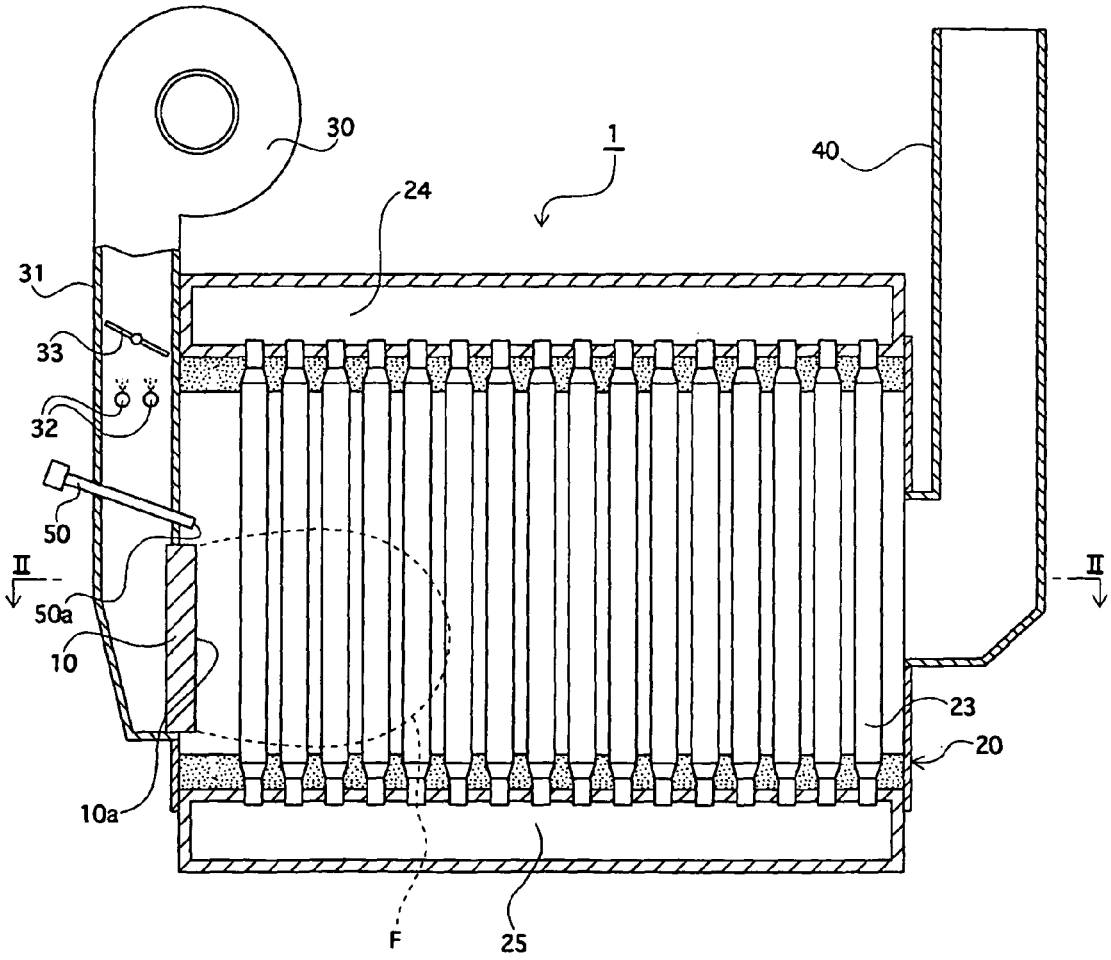
FIG. 1 is an explanatory longitudinal sectional view of a steam boiler to which an embodiment of the present invention is applied.
Figure 2:
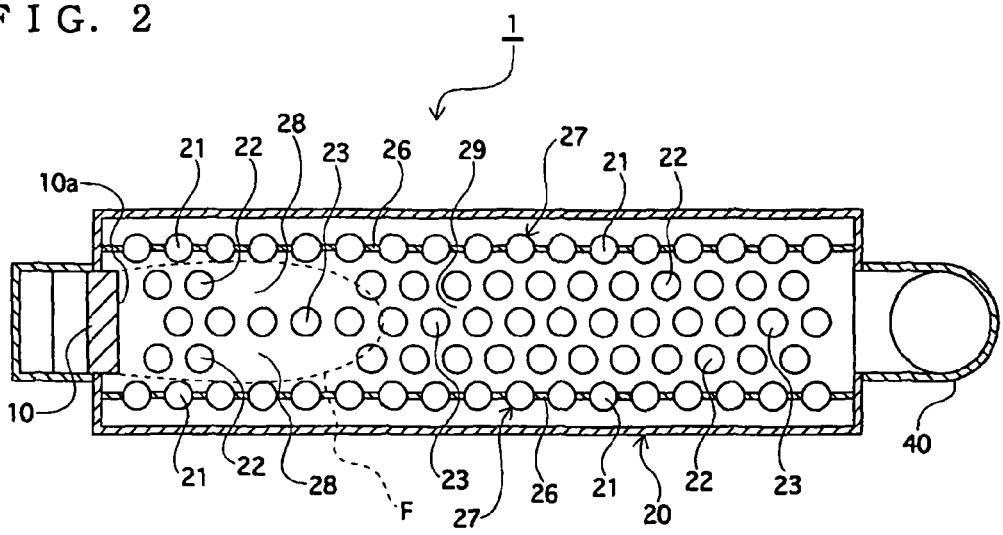
FIG. 2 is an explanatory cross-sectional view taken along the line II-II of FIG. 1.

FIG. 1 is an explanatory longitudinal sectional view of a steam boiler to which an embodiment of the present invention is applied, and FIG. 2 is an explanatory cross-sectional view taken along the line II-II of FIG. 1.

As shown in FIGS. 1 and 2, a boiler 1 according to this embodiment is composed of a complete premix type burner 10 (corresponding to the "main burner" of the present invention) having a flat premixed gas ejection surface (a flat combustion surface in which premixed gas ejection holes are formed substantially in the same plane), a boiler body 20 formed by using a large number of heat absorbing water tubes (heat transfer tubes) 21, 22, and 23, a blower 30 provided for the purpose of sending combustion air to the burner 10, a chimney portion 40 provided for the purpose of discharging exhaust gas inside the boiler body 20 to the exterior of the boiler 1. In addition, in this embodiment, a pilot burner 50 as an ignition means for the burner 10 is provided in close proximity to the burner 10. The burner 10 and the pilot burner 50 correspond to the "combustion apparatus" of the present invention. In FIGS. 1 and 2, a fuel supply route and an air supply route constituting a part of the pilot burner 50 are omitted so that the drawings may not be complicated.

The burner 10 constituting the boiler 1 of this embodiment is a premixed gas burner having a premixed gas ejection surface in which premixed gas ejection holes are formed substantially in the same plane, and is formed by alternately stacking together corrugated plates and flat plates. With this construction, a large number of premixed gas ejection holes are formed in the premixed gas ejection surface (combustion surface) 10*a* of the burner 10. The burner 10 is provided in close proximity to the water tubes (water tube groups) forming the boiler body 20. Although a detailed description of its structure, etc. is omitted here, the burner 10 of this embodiment has a construction similar to that of the "combustion burner" as disclosed in JP 3221582 B. Further, although a specific description of its structure is omitted, the burner 10 of this embodiment is formed so as to be capable of executing low combustion and high combustion through adjustment of the amount of gas fuel supplied and the amount of combustion air. Further, in the burner 10 capable of thus establishing combustion states in a number of stages, a low combustion state is first attained at the start of combustion, and then transition to a high combustion state is effected.

The boiler body 20 constituting the boiler 1 of this embodiment is formed by using an upper header 24, a lower header 25, a plurality of water tubes (outer water tubes 21, inner water tubes 22, and central water tubes 23) arranged upright between the upper and lower headers 24 and 25, etc. Inside the boiler body 20, the outer water tubes 21, the inner water tubes 22, and the central water tubes 23 are arranged in the gas flowing direction (the longitudinal direction of the boiler body 20), and inner water tube groups (water tube groups formed by using the inner water tubes 22) and outer water tube groups (water tube groups formed by using the outer water tubes 21) are formed, each in two rows, on either side of a central water tube group (a water tube group formed by using the central water tubes 23). The adjacent water tubes are arranged in zigzag form.

Further, as shown in FIG. 2, in the boiler body 20 of this embodiment, there are formed a pair of water tube walls 27 by using the outer water tubes 21 extending on either side in the longitudinal direction of the boiler body 20 and connecting portions 26 connecting the outer water tubes 21 to each other. By using the pair of water tube walls 27 and the upper and lower headers 24 and 25, there is formed in the boiler body 20 a substantially rectangular gas flowing space 29, in which the inner water tubes 22 and the central water tubes 23 are arranged at predetermined intervals.

Further, as shown in FIG. 2, in the boiler body 20 of this embodiment, there is provided a non-tube region 28 formed by removing some of the inner water tubes 22. In this embodiment, the non-tube region 28 is formed by removing two to four water tubes with a diameter (outer diameter) of approximately 60 mm from each of the inner water tube group in the gas flowing direction. The reason for forming the non-tube region 28 is to control the gas staying time. In this embodiment, the non-tube region 28 is formed such that a gas at a temperature of approximately 1300° C. is allowed to stay within the boiler body 20 for approximately 15 msec. That is, the non-tube region 28 is provided in order to secure the combustion space.

In the boiler body 20, constructed as described above, the gas is cooled by the water tubes 21, 22, and 23 in close proximity to the burner 10 to suppress the gas temperature, thereby making it possible to realize a reduction in NOx. In addition, in this boiler body 20, the gas oxidation reaction after abrupt cooling is promoted at the non-tube region 28, so it is also possible to realize a reduction in CO.

The blower 30 constituting the boiler 1 of this embodiment is provided in order to supply combustion air to the burner 10, and the blower 30 and the burner 10 are connected by using an air supply portion 31. In the air supply portion 31, there are provided gas fuel supply tubes 32, in which there are provided fuel adjusting valves (not shown) for adjusting the fuel flow rate for high combustion and low combustion.

Further, in the air supply portion 31, there is provided a damper 33 for adjusting the amount of air supplied from the blower 30 to the burner 10. The damper 33 is formed so as to be rotatable within the air supply portion 31. By adjusting the degree of opening of the air supply portion 31, the amount of air supplied to the burner 10 is controlled. Although omitted in FIG. 1, on the upstream side of the damper 33, there is provided one end of an air supply route for supplying air to the pilot burner 50.

The chimney portion 40 constituting the boiler 1 of this embodiment is provided on the most downstream side of the boiler body 20 such that the inlet thereof is opposed to the burner 10. Thus, in the boiler 1 of this embodiment, the gas generated at the burner 10 is brought into linear contact with the water tubes 21, 22, and 23 constituting the boiler body 20 (to undergo heat exchange through contact), and is then discharged to the exterior of the boiler 1 through the chimney portion 40 as exhaust gas.

Figure 3:
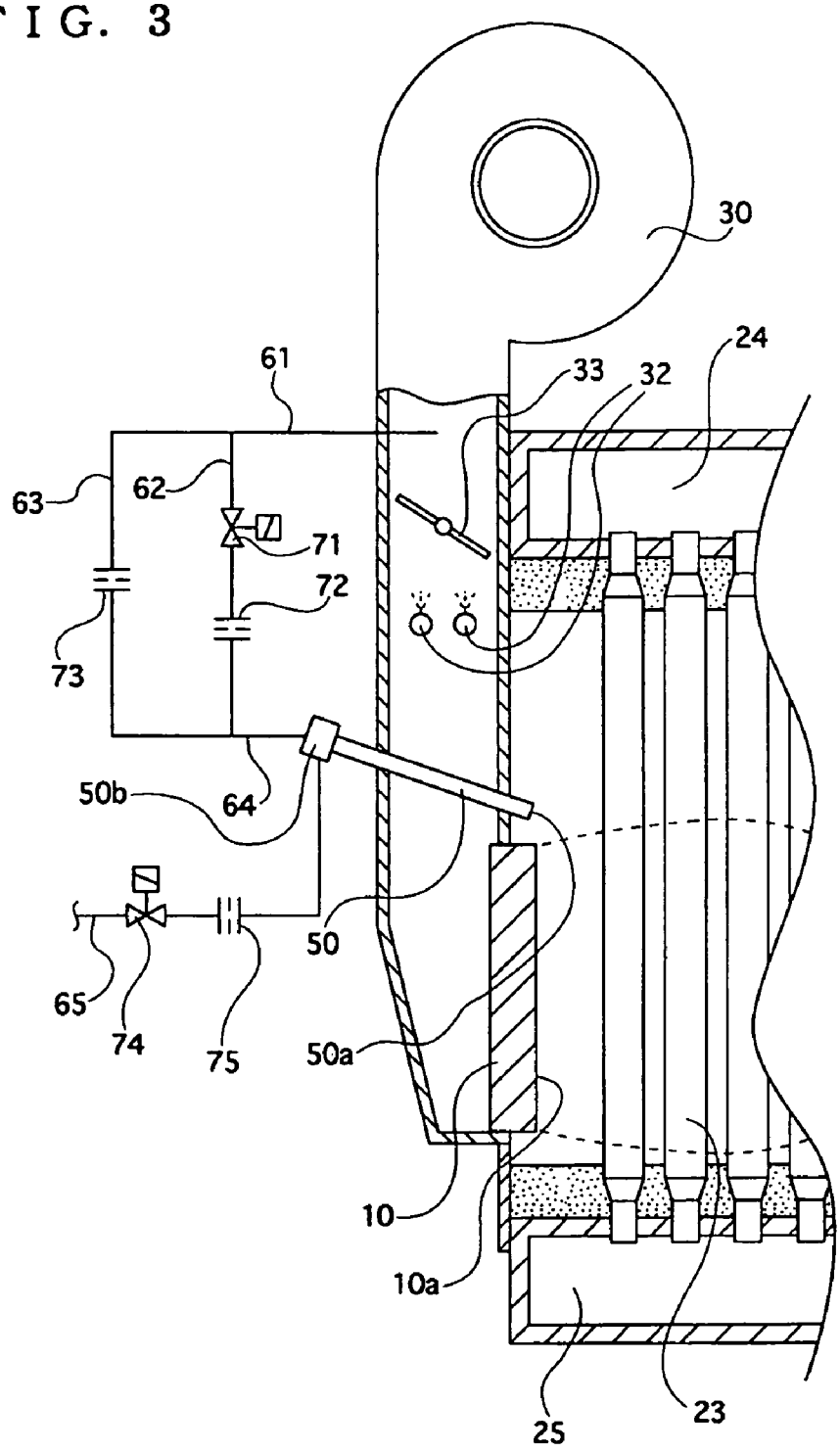
FIG. 3 is a schematic structural view of a pilot burner according to this embodiment.

The pilot burner 50 constituting the boiler 1 of this embodiment is formed as a cylinder, the forward end portion (premixed gas ejecting portion 50*a*) of which is provided in close proximity to the burner 10. To be more specific, it is formed as shown in FIG. 3. FIG. 3 is a schematic structural view of the pilot burner of this embodiment.

As shown in FIG. 3, the pilot burner 50 of this embodiment is equipped with a premixed gas ejecting portion 50*a* provided in close proximity to the premixed gas ejection surface 10*a* of the burner 10, and a premixed gas mixing portion 50*b* communicating with the premixed gas ejecting portion 50*a*. Connected to the premixed gas mixing portion 50*b* are a fourth air supply route 64 and a gas fuel supply route 65.

The fourth air supply route 64 provided for the purpose of supplying combustion air to the pilot burner 50 is connected to a second air supply route 62 and a third air supply route 63 that are branched off from a first air supply route 61 provided on the upstream side of the damper 33. Combustion air is supplied to the premixed gas mixing portion 50*b* of the pilot burner 50 by way of the first through third air supply routes 61, 62, and 63 and the fourth air supply route 64. Provided in the second air supply route 62 are a first electromagnetic valve 71 (which corresponds to the "supply amount adjusting means" of the present invention) and a first orifice 72, and provided in the third air supply route 63 is a second orifice 73. Further, a second electromagnetic valve 74 and a third orifice 75 are provided in the gas fuel supply route 65 provided for the purpose of supplying gas fuel to the pilot burner 50.

In this embodiment, the amount of air supplied to the pilot burner 50 as appropriate is adjusted by the first electromagnetic valve 71 provided in the second air supply route 62, and the amount of gas fuel supplied to pilot burner 50 is adjusted by the second electromagnetic valve 74 provided in the gas fuel supply route 65.

The boiler 1 of this embodiment, constructed as described above, provides the following operational effects.

In this embodiment, ignition of the pilot burner 50 is first effected, and then ignition of the burner 10 is effected by using the flame of the pilot burner 50. Low combustion or high combustion is effected at the burner 10. Even in the case of high combustion, transition from a low combustion state to a high combustion state is effected. Thus, in either case, in this embodiment, low combustion is first effected at the burner 10 by using the pilot burner 50.

When low combustion is effected at the burner 10, the amount of gas fuel and the amount of combustion air supplied to the burner 10 are throttled as compared to those in the case of high combustion. The amount of gas fuel is adjusted by the fuel adjusting valves (not shown) provided in the gas fuel supply tubes 32, and the amount of combustion air is adjusted by the degree of opening of the damper 33 in the air supply portion 31. That is, when supplying combustion air needed for low combustion, the damper 33 is tilted from the "open" state to the "closed" state, so the air pressure on the upstream side of the damper 33 is higher at the time of low combustion than at the time of high combustion.

As shown in FIG. 3, the first air supply route 61 for supplying combustion air to the pilot burner 50 is branched off on the upstream side of the damper 33, so when no special measure is taken (when, for example, it is simply connected by piping), high pressure air is ejected from the pilot burner 50 at the combustion start (low combustion start) of the burner 10, with the result that the ignition and the combustion state of the pilot burner 50 itself become unstable. However, in this embodiment, the first air supply route 61 is branched off into the second air supply route 62 and the third air supply route 63, and the orifices 72 and 73 are provided in the routes 62 and 63, respectively, so it is possible to supply proper combustion air to the pilot burner 50 (i.e., the premixed gas mixing portion 50*b* thereof) in correspondence with the degree of opening of the damper 33 at the time of low combustion.

In this embodiment, combustion air supplied through the air supply routes 61, 62, 63, and 64 and gas fuel supplied through the gas fuel supply route 65 as stated above are mixed at the premixed gas mixing portion 50*b*, and a premixed gas is ejected from the forward end portion of the pilot burner 50 (the premixed gas ejecting portion 50*a*) formed in a cylindrical configuration. Then, by using an ignition means, such as an ignition insulator (not shown), ignition is effected on the premixed gas ejected from the premixed gas ejecting portion 50*a* of the pilot burner 50.

Then, the gas fuel supplied from the gas fuel supply tubes 32 and the air supplied from the blower 30 are mixed with each other in the air supply portion 31, and a premixed gas prepared through mixing here is supplied to the burner 10. In this process, gas fuel is supplied from the gas fuel supply tubes 32 in an amount needed for low combustion (e.g., approximately 30% to 50% of high combustion) The adjustment of the supply amount of gas fuel is effected by a fuel adjusting valve (not shown). Air is supplied from the blower 30 in an amount needed for low combustion.

The premixed gas ejected from the premixed gas ejection surface 10*a* of the burner 10 is ignited by the pilot burner 50, and a gas F undergoing combustion reaction accompanied by a flame is formed at the burner 10. The premixed gas is ejected from the burner 10 so as to be substantially perpendicular (orthogonal) to the water tubes 21, 22, and 23 in the boiler body 20, so the gas F undergoing combustion reaction is repeatedly brought into contact with the water tubes 21, 22, and 23 in the boiler body 20 so as to cross them (to effect heat exchange with the water tubes), and is then turned into exhaust gas. Then, this exhaust gas is discharged to the exterior of the boiler 1 through the chimney portion 40 provided on the most downstream side of the boiler body 20.

After ignition of the burner 10 has been effected as described above, a low combustion state is maintained or transition from a low combustion state to a high combustion state is effected at the burner 10, thus maintaining the requisite combustion state for the boiler 1. After the ignition of the burner 10 has been confirmed, the pilot burner 50 attains its objective as the "ignition means", so the supply of gas fuel to the pilot burner 50 is stopped. To be more specific, the second electromagnetic valve 74 of the gas fuel supply route 65 is closed, and the supply of gas fuel is stopped.

When the supply of gas fuel is stopped as described above, solely "air" is ejected from the forward end portion of the pilot burner 50 (the premixed gas ejecting portion 50*a*). Here, if no special measure is taken for the pilot burner (see the prior-art technique), the combustion state of the burner 10 becomes unstable due to the "air" thus ejected, and various problems as stated above (e.g., generation of CO) are involved.

However, in this embodiment, the first electromagnetic valve 71 is provided in the second air supply route 62, so, by appropriately adjusting the opening/closing state of the first electromagnetic valve 71, it is possible to maintain a satisfactory combustion state for the burner 10 without involving any problems as in the prior art. To be more specific, the second electromagnetic valve 74 of the gas fuel supply route 65 is closed to stop the supply of gas fuel and, at the same time, the first electromagnetic valve 71 of the second air supply route 62 is also closed to reduce the amount of air supplied through the second air supply route 62 to "zero". With this construction, solely the slight amount of air supplied through the third air supply route 63 is ejected from the forward end portion of the pilot burner 50 (the premixed gas ejecting portion 50*a*).

The amount of air supplied through the third air supply route 63 is an amount which does not adversely affect the combustion state of the burner 10 and which allows cooling of the pilot burner 50. That is, air is supplied through the third air supply route 63 in an amount necessary for appropriately cooling the pilot burner 50, which is thermally influenced by the burner 10, and improving the durability of the pilot burner 50.

Thus, the opening diameter of the second orifice 73 of this embodiment is set so as to provide an amount of air which does not adversely affect the combustion state of the burner 10 and which allows cooling of the pilot burner 50. Further, the opening diameter of the first orifice 72 is set so as to provide an amount of air making it possible for the pilot burner 50 to maintain a proper combustion state when combined with the amount of air from the third air supply route 63 (the amount of air based on the opening diameter of the second orifice 73).

As described above, in this embodiment, at the time of extinction of the pilot burner 50, not only is the supply of gas fuel stopped, but also the supply amount of combustion air is controlled by using the first electromagnetic valve 71. In this control, the supply amount of combustion air is an amount which does not adversely affect the combustion state of the burner 10 and which allow cooling of the pilot burner 50.

Thus, according to this embodiment, even with a construction in which the pilot burner 50 is provided in the vicinity of the burner 10 (main burner), no air from the pilot burner 50 is blown against the flame formed by the burner 10 to cause a local reduction in flame temperature, and it is possible to suppress generation of CO and unburned substances.

In addition, the pilot burner 50 is supplied with a slight amount of air capable of cooling the pilot burner 50 itself, so the pilot burner 50, which is provided at a position in close proximity to the flame of the burner 10, is appropriately cooled, thereby improving its durability.

In particular, according to this embodiment, a remarkable effect is obtained in "low combustion" or in "a low capacity model", in which the amount of air from the pilot burner 50 increases with respect to the load of the burner 10 (main burner). Further, according to this embodiment, at the time of low combustion, the CO rising point in the exhaust gas (the point where the amount of CO begins to exhibit a tendency to increase) is on the high $O_2$ side, and a reduction in CO is achieved with the $O_2$ set at high level.

The present invention is not restricted to the embodiment modes and the embodiment described above but allows various modifications as needed without departing from the gist of the invention, and all of such modifications are covered by the technical scope of the present invention.

While in the embodiment described above the pilot burner 50 provided in close proximity to the burner 10 is formed as a cylindrical burner, the present invention is not restricted to this construction but is applicable as needed to pilot burners of various constructions. For example, it is also applicable to a construction as shown in FIG. 4.

Figure 4:
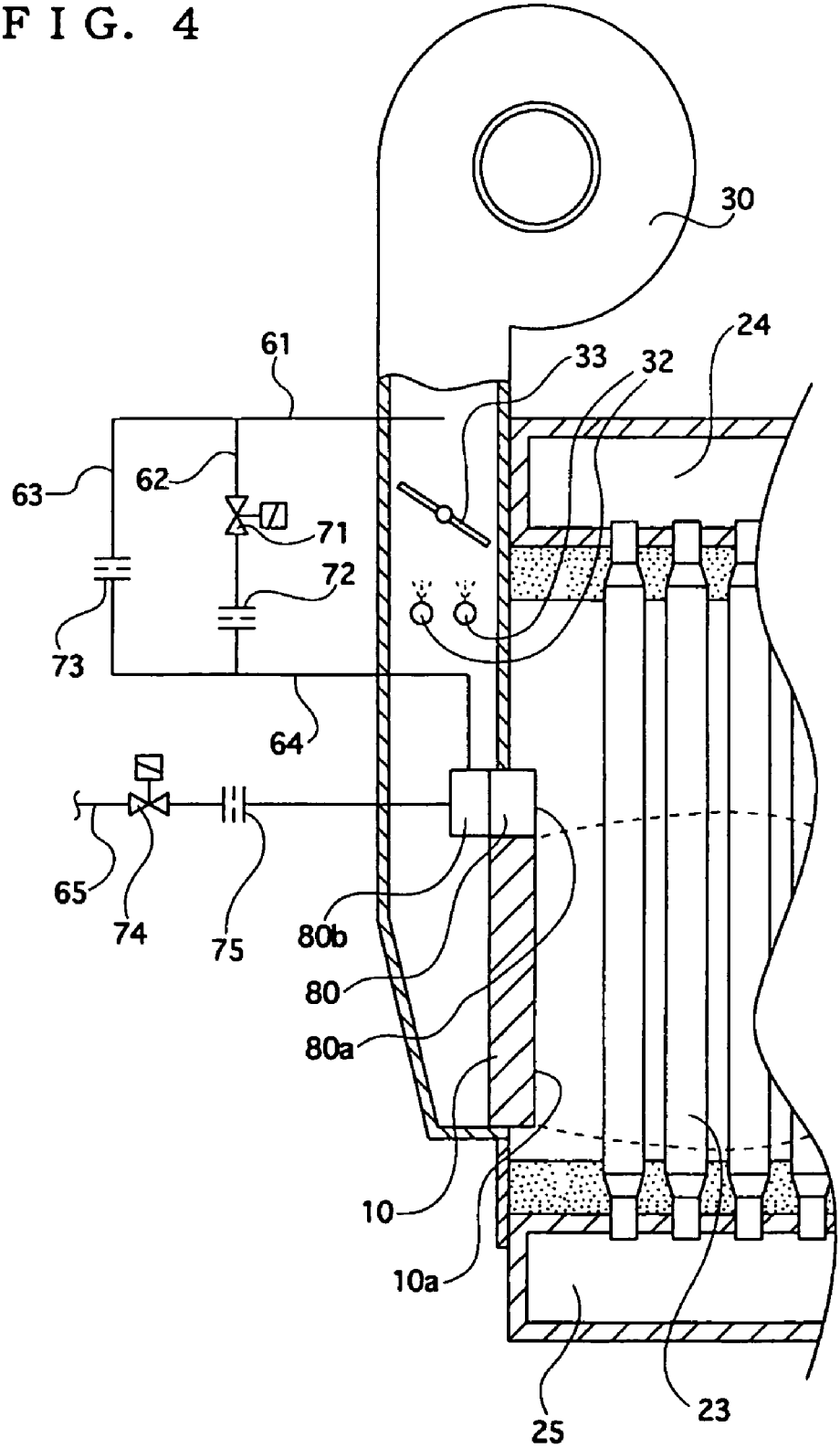
FIG. 4 is a schematic structural view of a pilot burner according to another embodiment of the present invention.

FIG. 4 is a schematic structural view of a pilot burner according to another embodiment. This embodiment is basically of the same construction as the one described above (see FIG. 3, etc.) except for a pilot burner 80, so, in the following, the components that are the same as those of the above embodiment are indicated by the same reference symbols, and a description thereof will be omitted. The following description will be mainly focused on the features of this embodiment.

As shown in FIG. 4, the pilot burner 80 of this embodiment is equipped with a premixed gas ejection surface 80*a* provided substantially in the same plane as the premixed gas ejection surface 10*a* of the burner 10, and a premixed gas mixing portion 80*b* communicating with the premixed gas ejection surface 80*a*, and connected to the premixed gas mixing portion 80*b* are the fourth air supply route 64 and the gas fuel supply route 65.

Like the burner 10, the pilot burner 80 is a premixed gas burner having a premixed gas ejection surface in which premixed gas ejecting holes are formed substantially in the same plane, and is formed, for example, by alternately stacking together corrugated plates and flat plates. Thus, it may be formed integrally with the burner 10, using a part of the integral unit as the pilot burner 80, or it may be formed separately from the burner 10, forming the pilot burner 80 so as to be in close contact with the burner 10. Further, the pilot burner 80 may be formed, for example, by using a ceramic plate having a large number of ejecting holes through which premixed gas is ejected.

As in the embodiment described with reference to FIG. 3, etc., in the pilot burner 80 of this embodiment, constructed as described above, combustion air supplied through the air supply routes 61, 62, 63, and 64 and gas fuel supplied through the gas fuel supply route 65 are mixed at the premixed gas mixing portion 80*b*, and premixed gas is ejected from the premixed gas ejection surface 80*a* of the pilot burner 80. Then, by using an ignition means, such as an ignition insulator (not shown), and ignition is effected on the premixed gas ejected from the premixed gas ejection surface 80*a* of the pilot burner 80.

After the burner 10 has been ignited by using the pilot burner 80, the supply of gas fuel is stopped, and the amount of air to be supplied to the pilot burner 80 is controlled by using the first electromagnetic valve 71 provided in the second air supply route 62.

The pilot burner 80 of this embodiment, which is constructed and functions as described above, can provide the same effect as that of the embodiment described with reference to FIG. 3, etc.

While in the above-described embodiments, the first electromagnetic valve 71 is provided in the air supply route 62 connected to the pilot burner 50 and 80 to control the supply air amount, the present invention is not restricted to this construction. It is possible to adopt any other construction as long as it is capable of controlling the amount of air supplied to the pilot burner. Thus, for example, it is also possible to adopt a construction in which opening/closing means, such as a shutter, is provided at the forward end of the pilot burner.

Further, while in the above-described embodiments a slight amount of air for cooling the pilot burner is supplied to the interior of the pilot burner, the present invention is not restricted to this construction. As long as the cooling of the pilot burner is possible, the amount of air inside the pilot burner may be "zero". Thus, for example, it is possible to adopt a construction in which, at the time of extinction of the pilot burner, the amount of air supplied to the interior of the pilot burner is reduced to zero, with air for cooling the pilot burner being supplied to the outer side of the pilot burner.

Further, while in the above-described embodiments the air supply is effected by way of the first air supply route 61 and the second and third air supply routes 62 and 63 branched off from the first air supply route 61, the present invention is not restricted to this construction. Thus, for example, in FIGS. 3 and 4, it is also possible to adopt a construction in which no third air supply route 63 is provided. When adopting such a construction, it is desirable to provide a supply amount adjusting means not only capable of opening/closing the route but also capable of adjusting the air amount as appropriate (that is, capable of adjusting the so-called degree of opening of the route). Examples of such a supply amount adjusting means include a damper, a ball valve (one capable of adjusting degree of opening or one equipped with a through-hole so that a slight amount of air may flow therethrough in the closed state), and a flow rate switching valve (one equipped with a through-hole so that a slight amount of air may flow therethrough with the electromagnetic valve closed). With such a construction, when igniting the pilot burner, the air supply route is opened to a corresponding degree of opening to supply air, and, when extinguishing the pilot burner, the degree of opening is adjusted so as to make it possible to supply the requisite amount of air for cooling the pilot burner. Further, as needed, it is also possible to bring the route into a totally closed state, reducing the amount of air supplied to the pilot burner to zero. The present invention does not exclude a construction in which the second air supply route 62 is provided with a supply amount adjusting means (e.g., an electromagnetic valve) that simply opens/closes the route, and it is also possible to adopt a construction in which, in addition to such a supply amount adjusting means, an element capable of supplying cooling air to the exterior (or the interior) of the pilot burner is provided.

Further, while in the above-described embodiments the boiler 1 is a steam boiler, this should not be construed restrictively. The present invention is also applicable to a hot water boiler.

Further, while in the embodiment modes and the embodiments described above the combustion apparatus of the present invention is applied to a boiler, this should not be construed restrictively. Thus, it is possible to apply the combustion apparatus of the present invention to some other apparatus, for example, a thermal component, such as a water heater or the reheater of an absorption refrigerating machine.

What is claimed is:

1. A combustion apparatus comprising:

a pilot burner;

a main burner;

an air supply route for supplying air to the pilot burner provided therein so that the air supply route is branched off from the upstream side of a damper for adjusting an amount of air supplied to the main burner, the air supply route is branched off from the upstream side of the damper to form a first air supply route;

a second air supply route branched off from the first air supply route, the second air supply route includes a valve;

a third air supply route branched off from the first air supply route; and a fourth air supply route connected to the second air supply route and the third air supply route, the fourth air supply route is coupled to the pilot burner, wherein, the supply of fuel to the pilot burner is stopped and a supply amount adjusting means substantially reduces the amount of air supplied to the pilot burner when the main burner is in a combustion state.

2. The combustion apparatus according to claim 1, wherein the amount of air supplied to the pilot burner is adjusted while not interfering with the combustion state of the main burner.

3. The combustion apparatus according to claim 1, the valve of the second air supply route is an electromagnetic valve.

4. The combustion apparatus according to claim 1, wherein an orifice is located between the first air supply route and the pilot burner.

5. The combustion apparatus according to claim 1, wherein the third air supply route includes an orifice.

* * * * *